US005366758A

United States Patent [19]

Jang

[11] Patent Number: 5,366,758

[45] Date of Patent: Nov. 22, 1994

[54] METHOD OF COATING AN INNER SURFACE OF A CATHODE RAY TUBE WITH LINING GRAPHITE

[76] Inventor: Hyung I. Jang, 150-27, Shinpyung1-dong, Kumi-si, Kyungsangbuk-do, Rep. of Korea

[21] Appl. No.: 865,093

[22] Filed: Apr. 8, 1992

[30] Foreign Application Priority Data

Apr. 15, 1991 [KR] Rep. of Korea ..... 6026/1991

[51] Int. Cl.[5] ..... B05D 5/12

[52] U.S. Cl. ..... 427/64; 427/68; 427/287; 427/591

[58] Field of Search ..... 427/64, 68, 287, 591

[56] References Cited

U.S. PATENT DOCUMENTS

| | | | |
|---|---|---|---|
| 4,035,525 | 7/1977 | Todd | 427/64 |
| 4,041,347 | 8/1977 | Deal | 427/64 |
| 4,085,235 | 4/1978 | Compen | 427/64 |
| 4,151,312 | 4/1979 | Compen | 427/64 |
| 4,623,820 | 11/1986 | Deal | 427/64 |

*Primary Examiner*—Janyce Bell
*Attorney, Agent, or Firm*—Fish & Richardson

[57] ABSTRACT

This invention relates to a method of coating an inner surface of a funnel of a cathode ray tube with lining graphite acting as an inner conductive film between a screen portion and a high voltage side, i.e., an electron gun of the cathode ray tube. According to the method, the lining graphite is coated on the entire inner surface of the funnel with the exception of only an area of the portion of the surface, on which a getter or a frittable getter is located.

8 Claims, 3 Drawing Sheets

METHOD OF COATING AN INNER SURFACE OF A CATHODE RAY TUBE WITH LINING GRAPHITE

BACKGROUND OF THE INVENTION

1. Field of the Invention

This invention relates to a method of coating an inner surface of a cathode ray tube with lining graphite, and more particularly a method of coating an inner surface of a funnel of a cathode ray tube with lining graphite which serves as an inner conductive film between a screen portion and electron gun of the cathode ray tube.

2. Description of the Prior Art

Generally, a cathode ray tube comprises a panel 1 and a funnel 2 provided with a neck portion 2*a* having a reduced cross-section and has an inner space 3 defined by the panel and the funnel. Furtheremore, an electron gun 4 is mounted within the neck portion 2*a* of the funnel to emit an electron beam 5, and a shadow mask 6 formed with small through-holes is disposed within the enlarged portion of the inner space 3 opposite the neck portion 2*a* through elastic support at the inner corners of the panel 1. In addition, a screen 7 having a luminous fluorescent material coated thereon in a given pattern is bonded to the inner surface of the panel 1.

With the cathode ray tube thus constructed, when the electron gun 4 mounted within the neck portion 2*a* is operated to emit the electron beam 5, the emitted electron beam passes through each through-hole of the shadow mask 6 and lands on the fluorescent material coated on the screen 7, thereby forming a given image on the screen. At this time, in order to enable the electron beam 5 emitted from the electron gun to be accelerated by a high voltage applied by the electron gun through the lining graphite and aluminum films (not shown) coated on the shadow mask and the screen, and thus effectively land on the screen coated with the fluorescent material, the inner space 3 of the cathode ray tube must be maintained in a high vacuum state of approximately $10^{-6} \sim 10^{-7}$ Torr (hereinafter referred to as "the set degree of vacuum"). In a typical manufacturing process of the cathode ray tube, this vacuum is not obtained, and instead the tube has the a of vacuum only on the order of $10^{-4} \sim 10^{-5}$ Torr.

When the inner space 3 has a degree of vacuum less than the set degree of vacuum, the electron beam 5 emitted from the electron gun 4 fails to effectively land on the screen 7. Therefore, in order to compensate for such a low degree of vacuum, as shown in FIG. 2A, a getter 10 having a frame 10*a* connected to a high voltage electrode 4*a* of the electron gun 4 is disposed within the inner space of the cathode ray tube in supported relation to the inner surface of the funnel 2, and then, the sealing process of the funnel is carried out. Thereafter, a high-frequency induction coil 9 is attached to the outer side of the funnel to carry out getter flashing by high-frequency induction heating. As a result of the flashing, the principal ingredients, such as barium, nickel, etc., of the getter 10 are dispersed to every nook and corner of the inner space 3 of the cathode ray tube to adsorb and remove foreign matters obstructing traveling of the electron beam 5.

While, in a small-sized cathode ray tube, the thus obtained vacuum satisfactorily gets to the high vacuum state having the set degree of vacuum (appoximately $10^{-6} \sim 10^{-7}$ Torr) the flashing of only the getter 10 by the high-frequency induction heating in a large-sized cathode ray tube (of more than 25 inches) fails to satisfactorily attain the desired degree of vacuum. In view of this, in the large-sized cathoe ray tube, as shown in FIG. 2B, in addition to the getter 10 disposed on the inner surface of the funnel 2, a frittable getter 11 having a frame 11*a* is addittionally mounted on the inner surface of the funnel portion adjacent to the screen, thereby enabling to realize the set degree of vacuum.

In the past, high-frequency induction heating of the getter or the frittble getter disposed within the funnel by the high-frequency induction coil located outside of the funnel has been carried out with graphite coated on the entire inner surface of the funnel of the cathode ray tube as shown in FIG. 3, thereby dispersing the principal ingredients of the getter or the frittable getter. However, if the high-frequency induction heating is performed with the lining graphite coated as set forth above, the lining graphite is carbonized and the resultant waste of the carbonized graphite is moved toward the electron gun due to vibration or any other movement of the cathode ray tube, thereby giving rise to a discharge phenomenon in the cathode ray tube and thus deteriorating a withstand voltage characteristic of the high voltage side.

SUMMARY OF THE INVENTION

In view of the aforesaid problem of the prior art, it is an object of the present invention to improve a withstand voltage characteristic of a high voltage side of a cathode ray tue during flashing operation of a getter in the cathode ray tube.

To achieve the above object, there is provided according to one aspect of the present invention a method of coating an inner surface of a cathode ray tube with lining graphite acting as an inner conductive film between a screen portion and an electron gun within the cathode ray tube, characterized in that the lining graphite is coated on the entire inner surface of a funnel of the cathode ray tube with the exception of only an area of the portion of the surface, on which a getter is located.

DESCRIPTION OF THE PREFERRED EMBODIMENT

The present invention will now be described in detail with reference to FIGS. 4 and 5 of the accompanying drawings.

Figure 1:
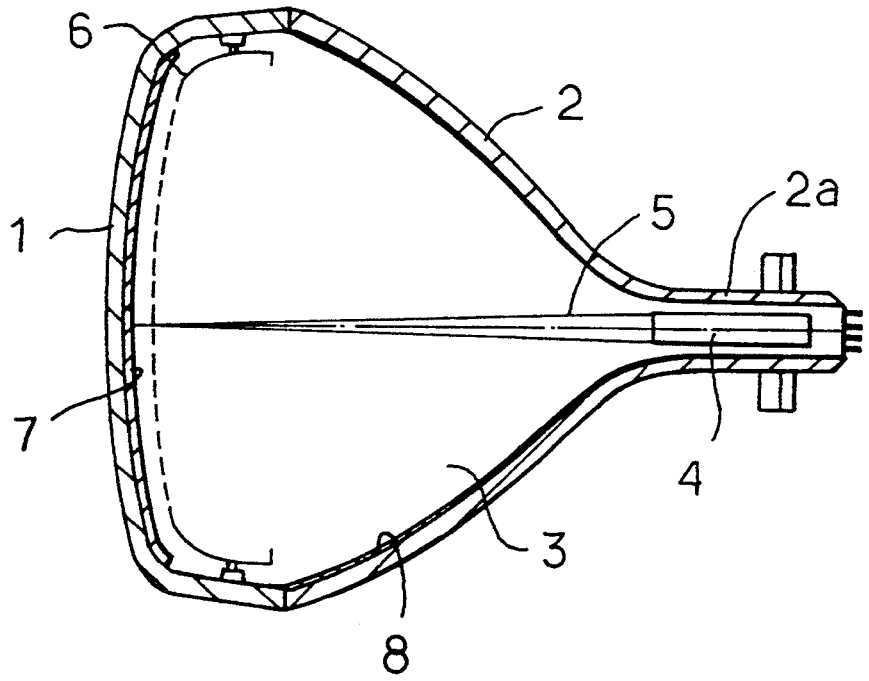
FIG. 1 PRIOR ART
FIG. 1 is a diagrammatic cross-sectional view of a typical cathode ray tube.
Figure 2A:
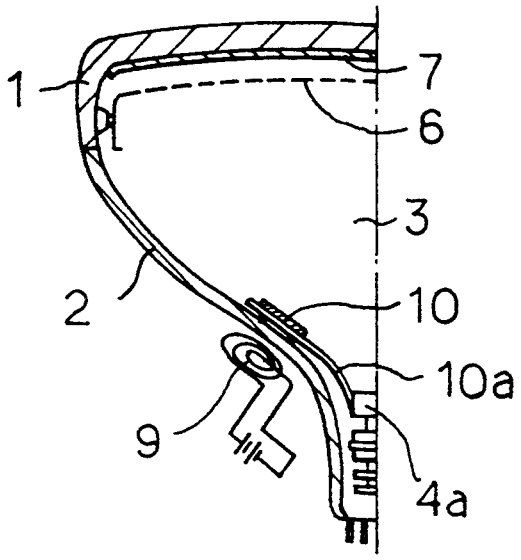
FIG. 2A PRIOR ART
FIG. 2A is a cross-sectional view of a left half of the cathode ray tube, showing a mounting position of a getter according to the prior art.
Figure 2B:
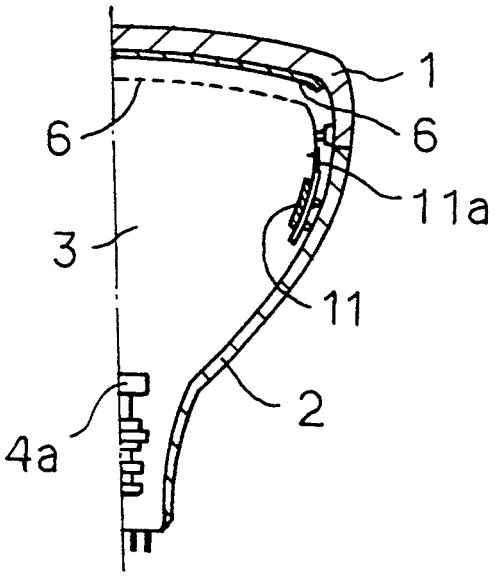
FIG. 2B PRIOR ART
FIG. 2B is a cross-sectional view of a right half of the cathode ray tube, showing a mounting position of a frittable getter used in a largesized cathode ray tube according to the prior art.
Figure 3:
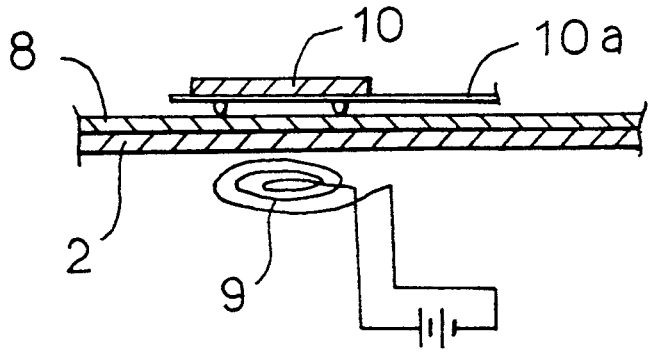
FIG. 3 PRIOR ART
FIG. 3 is a cross-sectional view of a getter mounting area, showing a lining graphite coating state according to the prior art.
Figure 4:
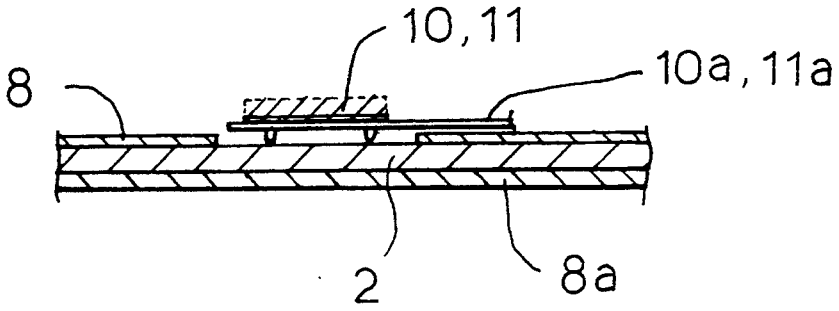
FIG. 4 is a cross-sectional view of a getter mounting area showing a lining graphite coating state according to the present invention.
Figure 5:
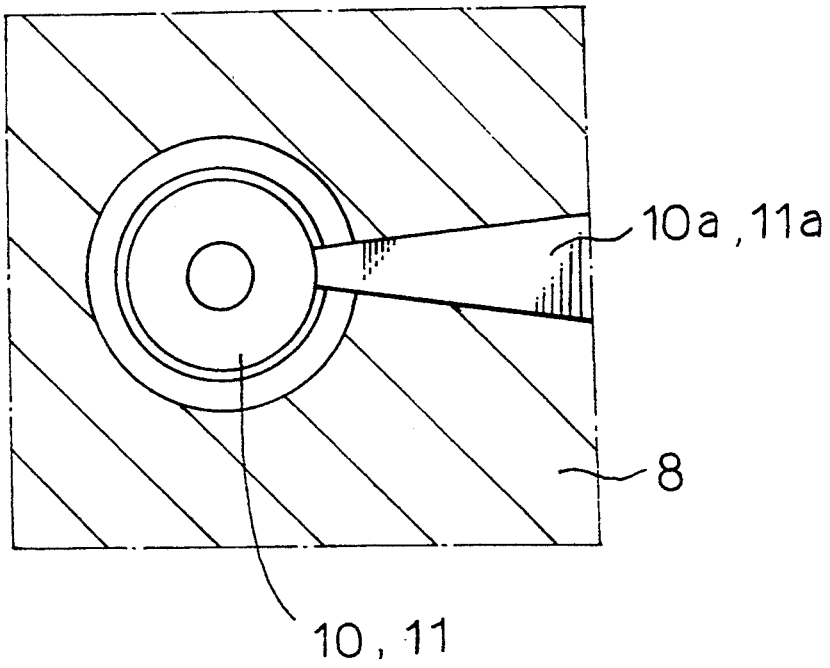
FIG. 5 is a plan view showing the lining graphite coating state accoding to the presnet invention.

According to the lining graphite coating method of the present invention, as shown in FIGS. 4 and 5, lining graphite 8 acting as an inner conductive film betwen a screen portion and an electron gun in a cathode ray tube is uniformly coated on the entire inner surface of a funnel 2 of the cathode ray tube with the exception of only an area of the portion of the surface, on which a getter 10 or a frittable getter 11 is located. The getter or the frittable getter disposed within the cathode ray tube is heated by a high-frequency induction coil, as in the prior art described above. In this way, since the lining graphite (which is subject to burning during the high-frequency induction heating) is not applied around the getter 10 or the frittable getter 11, materials of the getter or the frittable getter are dispersed to the inner space of the cathode ray tube during the high-frequency induction heating without undesirable buring of the graphite.

After the completion of the vacuum producing process, an outer graphite coating 8*a* acting as an outer conductive film is applied to the outer surface of the cathode ray tube, as shown in FIG. 4.

As discussed above, the present invention is advantageous in that since the lining graphite is not applied to the area of the inner surface of the funnel 2 on which the getter 10 or the frittable getter 11 is disposed, the possibility of falling off of the waste of the carbonized graphite within the cathode ray tube can be eliminated Thus, a discharge phenomenon caused by the waste of the carbonized graphite in the cathode ray tube can be prevented, resulting in an withstand voltage characteristic of the high voltage side of the tube.

Having described but a single embodiment of this invention, it will be apparent that changes and modifications can be made therein without departing from the spirit and scope of the invention as defined in the appended claims.

What is claimed is:

1. A method of coating an inner surface of a cathode ray tube with a graphite lining which acts as an inner conductive film between a screen portion of the cathode ray tube and an electron gun to be disposed within the cathode ray tube, comprising the steps of:

coating the inner surface of the funnel portion of the cathode ray tube with the graphite lining, with the exception of a reserved area of the inner surface on which a getter is to be located, and positioning a getter at the reserved area of the inner surface.

2. A method as claimed in claim 3, wherein said getter is a frittable getter.

3. A method as claimed in claim 1, wherein the step of coating further comprises coating the inner surface of the funnel portion of the cathode ray tube with the graphite lining, with the exception of a second area of the inner surface on which a second getter is to be located, the method further comprising the step of positioning a frittable getter at the second area.

4. A method as claimed in claim 3, further comprising the step of coating the outer surface of the cathode ray tube with an outer graphite coating.

5. A method of increasing a vacuum within a cathode ray tube, comprising the steps of:

providing a getter within the cathode ray tube;

coating the inner surface of a funnel portion of the cathode ray tube with a graphite lining without coating a portion of the inner surface corresponding to the location of the getter; and applying high-frequency induction heating to the getter via said portion of the inner surface not coated with the graphite lining.

6. A method as claimed in claim 5, further comprising the step of coating the outer surface of the cathode ray tube with an outer graphite coating.

7. A method of increasing a vacuum within a cathode ray tube, comprising the steps of:

coating an inner surface of a funnel portion of the cathode ray tube with a graphite lining, with the exception of a reserved area of the inner surface, positioning a getter at the reserved area, sealing the funnel, and then applying high-frequency induction heating to the getter via said reserved of the inner surface not coated with the graphite lining.

8. A method as in claim 7, further comprising coating the outer surface of the cathode ray tube with an outer graphite coating.

* * * * *